United States Patent [19]

Hardouin et al.

[11] Patent Number: 4,576,429

[45] Date of Patent: Mar. 18, 1986

[54] CONNECTION DEVICE FOR ELECTRIC CONDUCTOR

[75] Inventors: Pierre Hardouin, Asnieres; Felix Lameyre, Rueil Malmaison; Claude Paris, Ermont, all of France

[73] Assignee: La Telemecanique Electrique, France

[21] Appl. No.: 542,844

[22] Filed: Oct. 17, 1983

[30] Foreign Application Priority Data

Oct. 15, 1982 [FR] France ..... 82 17256

[51] Int. Cl.[4] ..... H01R 4/26

[52] U.S. Cl. ..... 339/95 D

[58] Field of Search ..... 339/95 D

[56] References Cited

FOREIGN PATENT DOCUMENTS 1575118 4/1970 Fed. Rep. of Germany ... 339/95 D 2306544 10/1976 France ..... 339/95 D

*Primary Examiner*—Joseph H. McGlynn

*Attorney, Agent, or Firm*—William A. Drucker

[57] ABSTRACT

A device for connecting an electric conductor mounted within a housing is provided, on a first lateral face, with an opening for the introduction of the electric conductor and, on a further lateral face perpendicular to the first one, with another opening for the introduction of a tool. Said device comprises a contact member secured within the housing and means for resilient jamming of the electric conductor against the contact member. The means for resiliently jamming the conductor consist of a single member comprising a presser tongue contained in a plane making an acute angle with the plane of the contact member and a portion for transmitting the resilient force created by resilient means which bear on the face of the contact member opposite to that on which the tongue bears. The portion is contained in a plane adjacent to the contact member at right angles with the plane of the contact member and parallel to the direction of introduction of the wire.

7 Claims, 11 Drawing Figures

CONNECTION DEVICE FOR ELECTRIC CONDUCTOR

BACKGROUND OF THE INVENTION

1. Field of the Invention

The present invention relates to a device connecting an electric wire to an apparatus or several wires to each other.

2. Description of the Prior Art

There are already known connection devices comprising a contact member and a leaf spring, as disclosed in the Patent Application DE No. 2724354. One end of the blade is fixed and the other end bears on the contact member in such a manner that the blade and the surface of the contact member form an acute angle. An electric wire inserted into the acute angle between the blade and the contact surface is pressed against the surface of the blade. Furthermore, its withdrawal is prevented by jamming between the blade and the surface. However, such devices have the disadvantage of not being easy to handle and of necessitating the use of strong forces when the section of the wire to be inserted is increased. Similarly, when it is desired to couple wires of section varying for example between 0.75 and 4 $mm^2$, the resilient blade will assure an anchorage of the wire which is less good as the diameter of the wire is greater. In effect, as the diameter of the wire is made greater, the more so does the blade come into contact tangentially with the wire and it is then easy to disconnect the wire by pulling it upwardly.

There is also known, from German Patent Application No. 2619035, a connection device comprising a contact member and a spring blade anchored on the face of the contact member opposite to the contact surface. The blade spring also has, near to its other end, a cut out window permitting the passage of the contact member between two lateral legs and. The transverse portion of the window couples the two legs jams the conductor wire against the contact member. This device loses a large part of the width available to permit the passage of the legs of the spring blade. Consequently, the section of the wires is quickly limited for a given width.

SUMMARY OF THE INVENTION

The principal object of the invention is to avoid these disadvantages and more particularly to provide a connection device which, for a given size of the apparatus, will enable one to connect wires of greater cross-section, and to assure a good jamming effect of the conductor on the contact member.

Another object of the invention is to provide a connection device enabling one to obtain an easy connection and disconnection of the conductor by pivoting of the blade by means of a tool such as a screw-driver, the tool being introduced in a direction which is either substantially perpendicular or substantially parallel to that of the conductor.

According to the invention, the connection device for an electrical conductor is mounted within a housing, provided on one lateral face with at least one opening for the introduction of the electrical conductor and, on this same face or on a perpendicular second lateral face, at least one opening for the introduction of a tool. The said connection device comprises a contact member fixed in the housing and means for resiliently jamming an electrical conductor against the contact member and means for un-jamming the conductor, said means for resiliently jamming the conductor consisting of a single tilting member which comprises a presser tongue contained in a plane forming an acute angle with the plane of the contact member and a part subjected to a resilient force created by resilient means bearing on the face of the contact member opposite to that on which the tongue bears, the said part being contained in a plane adjacent to the contact member, said plane being at right angles with the plane of the contact member and parallel to the direction of introduction of the wire.

BRIEF DESCRIPTION OF THE DRAWING

Other features and advantages of the invention will clearly appear from the following description. In the accompanying drawings:

FIGS. 9 and 10 show another modification of the connection device and.

DESCRIPTION OF THE PREFERRED EMBODIMENT

Figure 1:
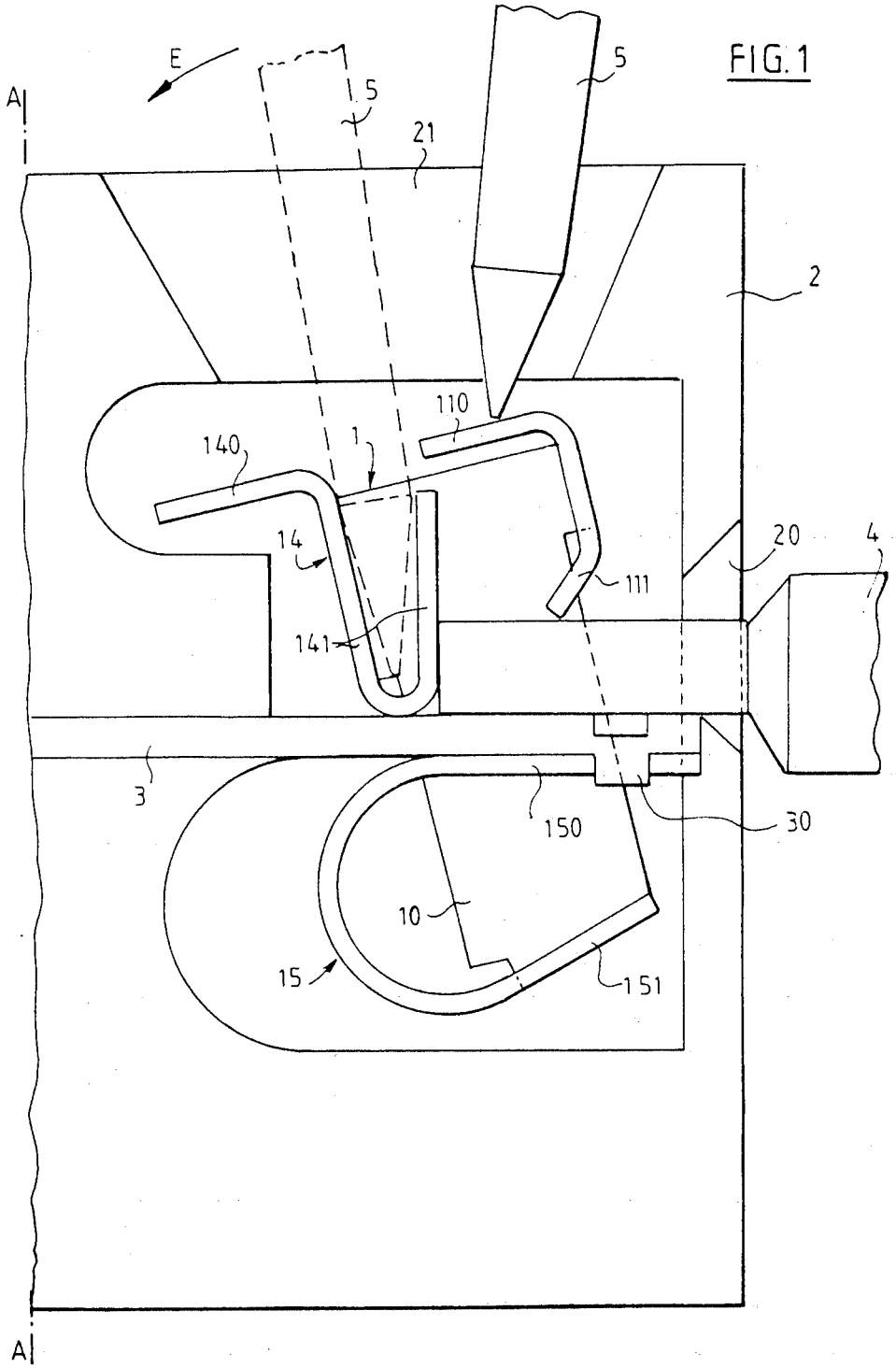
FIG. 1 is a side view of a connection device mounted in an open housing or terminal cover hood.

The connection device shown in FIG. 1 comprises a housing of mouldable and insulating material. The housing portion 2 which is illustrated in the drawing is provided with at least one opening 20 for the introduction of a conducting wire 4 and at least one opening 21 for the introduction of a screw-driver. The portion of housing 2 has a recess for a contact member 3 made of an electrically conductive material, and another recess for a jamming element 1 made of a resilient material, such as for example spring steel.

Member 3 can be electrically connected to any part of any industrial or household electrical apparatus, such as for example a circuit-breaker, relay, contactor etc., in such a manner that the device constitutes a connection terminal for the apparatus. In this case, the housing portion 2 forms a part of the housing of the apparatus and constitutes a terminal cover hood.

Figure 3:
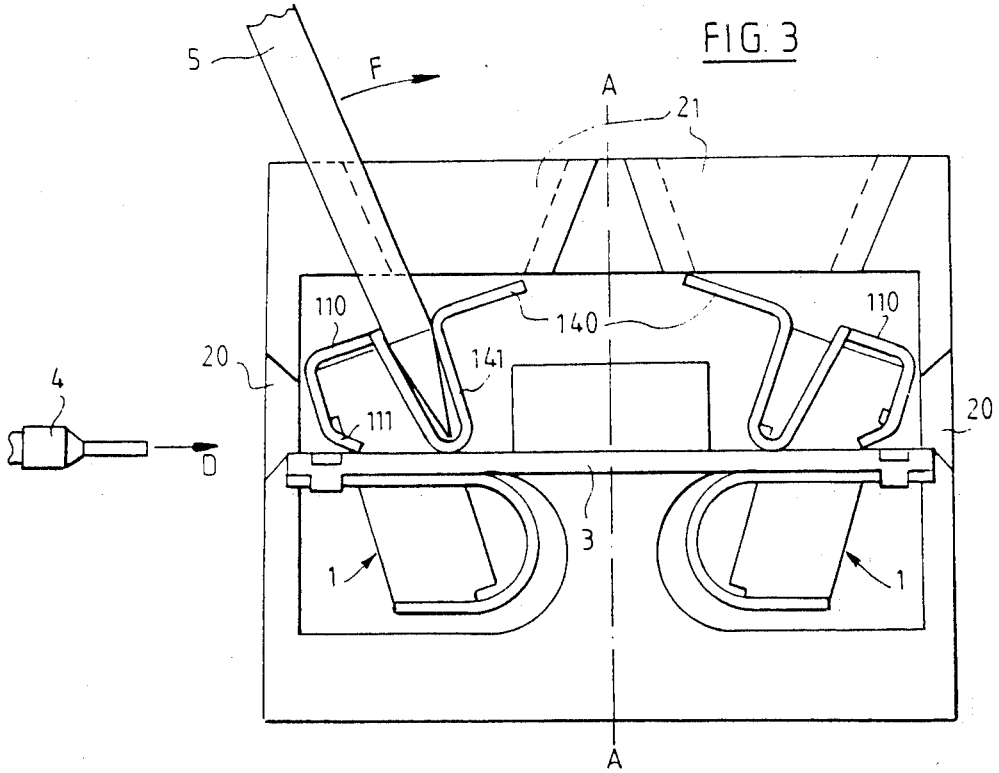
FIG. 3 shows a connection device used to carry out the connection of two wires in series, placed in a housing the cover of which has been removed.
Figure 5:
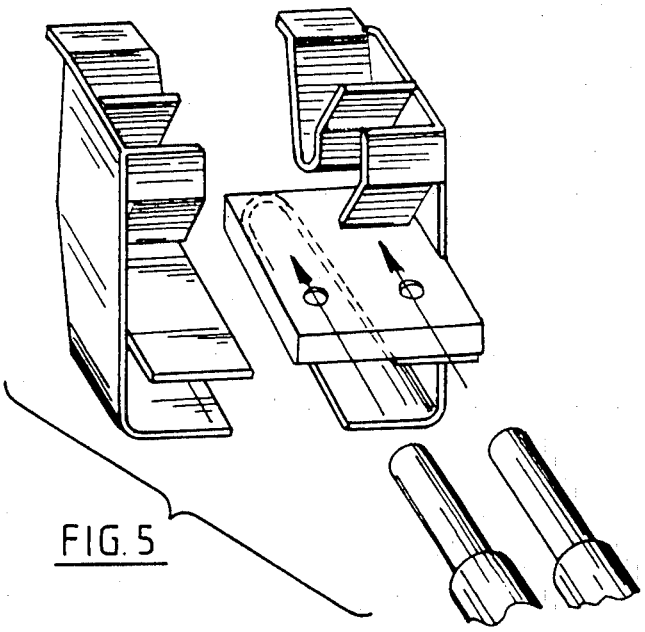
FIG. 5 is a perspective view of a double connector for performing a parallel connection.

In another use, it is possible to envisage the device being symmetrical with respect to the axis AA, and/or with respect to the plane of FIG. 5, in such a manner as to constitute a device for the connection of several conducting wires to each other, as shown for example in FIGS. 3 and 5. In this case, the open housing 2 will be completed by a cover, not shown.

Figure 4:
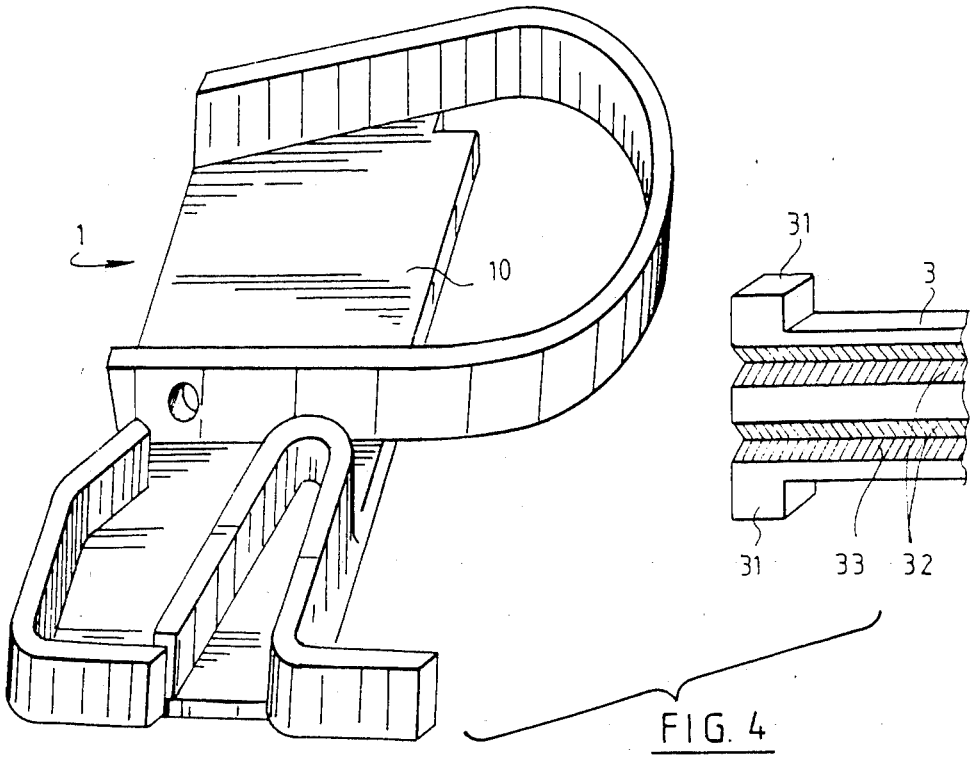
FIG. 4 is a perspective view of the jamming member and of the contact member.

Member 3 comprises anchoring means 30 constituted for example by a lug which is engaged into a hole 152 (FIG. 2) provided in the arm 150 of a U-shaped resilient blade 15, the other arm 151 of which is rigidly locked with the portion 10 of the jamming member 1. Member 3 likewise comprises means for hooking it in the housing 2; in the example which is illustrated, these means are formed by tongues 31 (FIG. 4).

On member 3 there is mounted the jamming member 1 of resilient material (FIG. 2), which comprises here a resilient blade 15 bent into the shape of a "U", the first leg 150 of which is anchored on the lug 30 by means of a hole 152, whilst the second leg 151 comprises, by a lateral side which is rigidly locked with a plate portion 10.

Figure 2:
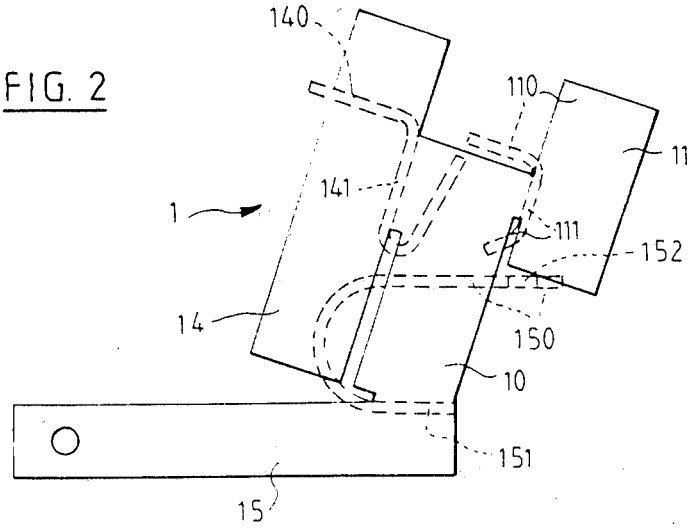
FIG. 2 is a side view of the jamming member of the said connection device.

In FIG. 2 there has been shown in full line the cut out of the resilient sheet before bending, and in dotted line the position of the elements after bending.

Portion 10 is located in a plane perpendicular to the plane of the U-shaped resilient blade. This return portion 10 is extended at its part remote from the resilient blade by two ears 11,14. The first ear 11, after bending in a plane perpendicular to the plane of portion 10, constitutes a pressing tongue 111 the principal direction of which forms an acute angle with the direction of introduction of the wire 4. This pressing tongue 111 is extended by a portion 110 which, once bent, lies in a direction substantially parallel to the edge of portion 10 opposite to the edge rigidly locked with the resilient leg 151.

This portion 110 serves as an anti-fault means to avoid a screw-driver being introduced into an incorrect place.

Moreover, this portion 110 can likewise serve as a bearing point for the free leg of the indentation 141, as shown in FIG. 3. The second ear 14 is bent in a plane perpendicular to the portion 10, in such a manner as to form a profile in the shape of an indentation 141. The free leg of this profile can bear on the portion 110, in order to avoid any opening of the indentation under the action of the screw-driver. This indentation 141 is extended by a tongue 140 having its direction parallel to the portion 110. This tongue 140 also serves as an anti-fault means, to avoid the introduction of a screw-driver anywhere else other than in the indentation 141. The openings 21 are arranged in such a manner that the screw-driver can be introduced when the element 1 is in the working position, which corresponds to the greatest section of the wire, or in the rest position.

The operation of the apparatus will be explained with reference to FIGS. 1 and 3, in which FIG. 3 shows a double connection device obtained by duplication symmetrically with respect to the plane AA. This device is useful for joining two conducting wires to each other. In FIG. 3 there can be seen a screw-driver 5 introduced into the indentation 141. On this screw-driver there is exerted a tilting force in the direction of the arrow F, in such a manner as to tilt member 1 and to detach the presser tongue 111 from the contact member 3, in order to permit the passage of the conducting wire 4, provided with a ferrule and which is introduced in the direction of the arrow D. When the wire has been introduced sufficiently and abuts against the indentation 141, the tilting force F is removed and member 1, under the action of the resilient blade 15, has a tendency to return to its rest position shown in FIG. 3.

In returning to its rest position, the pressing tongue 111 meets the end of the ferrule or of the bared wire. The pressing tongue pinches the wire against the contact member, with an angle such that any attempt to withdraw the wire, by pulling on it, increases the jamming and results in a checking action.

The great flexibility and great movement of the resilient blade permit the connection of wires whose sections vary in wide proportion for a connector of given dimensions; for example sections of 0.75 $mm^2$ to 4 $mm^2$.

To withdraw a wire, it is sufficient to introduce the screw-driver 5 into the indentation 141, whilst member 1 is in its working position as shown in FIG. 1. In this figure, can be seen the action of the tongue 110 which avoids, when member 1 is in the working position, the screw-driver being introduced otherwise than into the indentation.

The same purpose is played by the tongue 140 for the rest position, as can be seen in FIG. 1. Once the screw-driver is introduced into the identation, as shown in dotted lines in FIG. 1, a force E is exerted in opposition to the resilient force of the blade 15 which results in the disengagement of the tongue 111 from the wire and permits the wire to be withdrawn.

Then, the element 1 comes again under the action of the resilient blade, as soon as the force E is ceased, and it then comes back into the rest position of FIG. 3.

It is obvious that it would be possible, as a modification, to add, on the side of the housing 2 opposite to the openings 21, a pawl device on a Ω shaped rail.

FIG. 4 shows a view in perspective of member 1 and the contact member.

This contact member 3 has a width double that of the tongues of member 1; it thus permits the mounting face to face of the two jamming members 1, as shown in FIG. 5. These jamming members 1 are mounted in such a manner that their portions 10 are at the exterior. This contact member comprises, as well as the lugs 30 not seen in this figure, two V-grooves 32 shaped fluted transversely by flutes 33 to increase the anchoring of the wire. Similarly, the heads 31 can serve as means for anchoring of member 3 in the housing and as stop means for the support of portion 10. With such a contact member 3, it is simple to provide, by associating it with two members 1, a double connector as shown in FIG. 5, permitting the connection of two wires to the same contact member 3.

MODIFIED EMBODIMENTS

Figure 6:
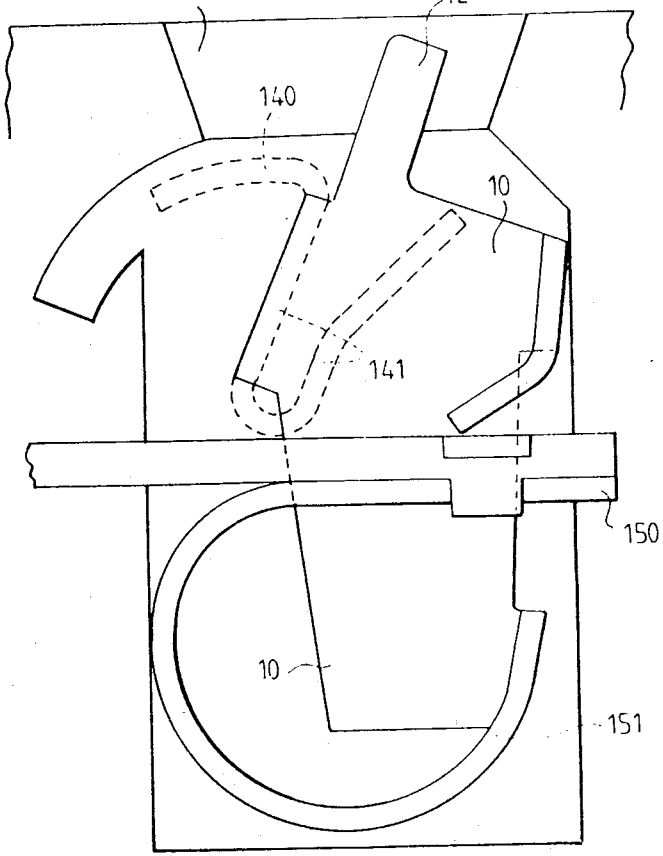
FIG. 6 is a side view of a modified embodiment of the connection device.

FIG. 6 shows another embodiment of the device, in which the resilient arm 151 of the resilient blade 15 is rigidly bound, not with an end of plate 10, but with a longitudinal side of this plate (as shown in FIG. 6) in such a manner as to increase the length of the resilient blade and its possibilities of flexing, and consequently to increase the sections of the wires.

Instead of using cutting out and bending to form the identation 141 shown in dotted line, the return portion 10 is extended by a tongue 12 which, if it does not pass beyond the plane of the opening, will be actuated by a screw-driver. If the tongue 12 comes out of the plane of the opening 21, it will bear an insulating hood which will permit its actuation directly by the operator.

It is obvious that the resilient force actuating the tilting member could be created by a separate spring, but this force can be more advantageously provided by the resilient blade 15 integrated with the tilting member.

Figure 7:
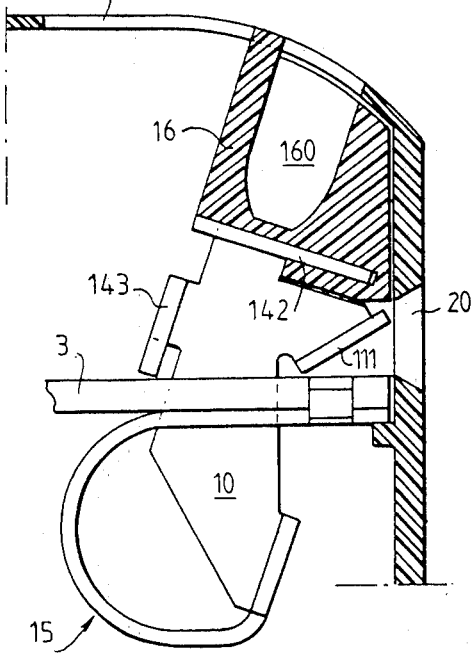
FIGS. 7 and 8 show, in two different positions of the tilting member, a side view of a modified embodiment of the connection device.
Figure 8:
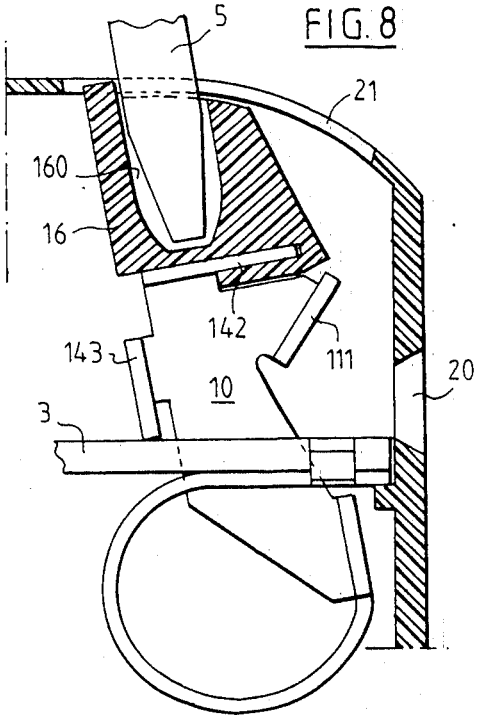

FIGS. 7 and 8 show another embodiment of the connection device. The single resilient jamming member 1 is provided with a socket 16 of insulating material; this socket 16 is assembled by any convenient means to a tongue 142 obtained by bending of member 1 and it has a recess 160 of a depth determined suitably for the end of the screw-driver. Member 1 is illustrated in its position of rest in the absence of a conductor in FIG. 7, and in its position of un-jamming of the conductor in FIG. 8.

Figure 9:
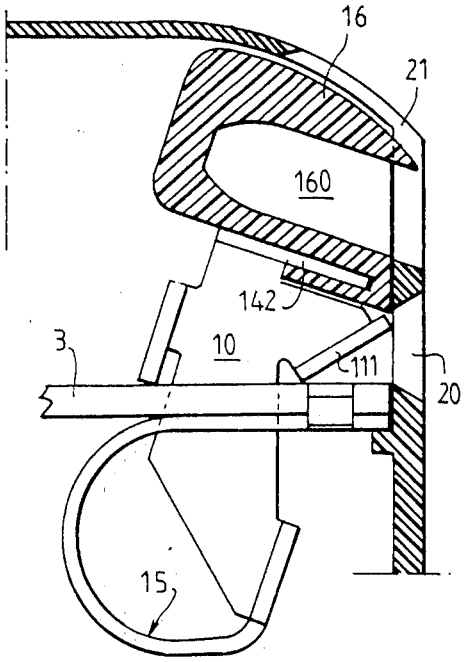
Figure 10:
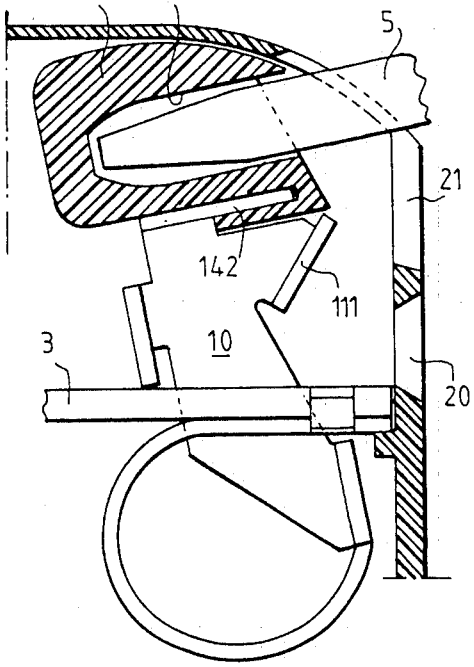

FIGS. 9 and 10 are views similar to FIGS. 7 and 8 and show a connection device permitting an introduction of the tool in a direction substantially parallel to that of the conductor; this embodiment is found to be particularly useful on certain configurations of apparatus incorporating the connection device and necessitating a frontal approach both of the tool and of the conductor. The insulating socket 16 is assembled like that of FIGS. 7 and 8 to the tongue 142 of member 1. The retaining tongue 142 of the socket could obviously be disposed at other positions of the member.

Figure 11:
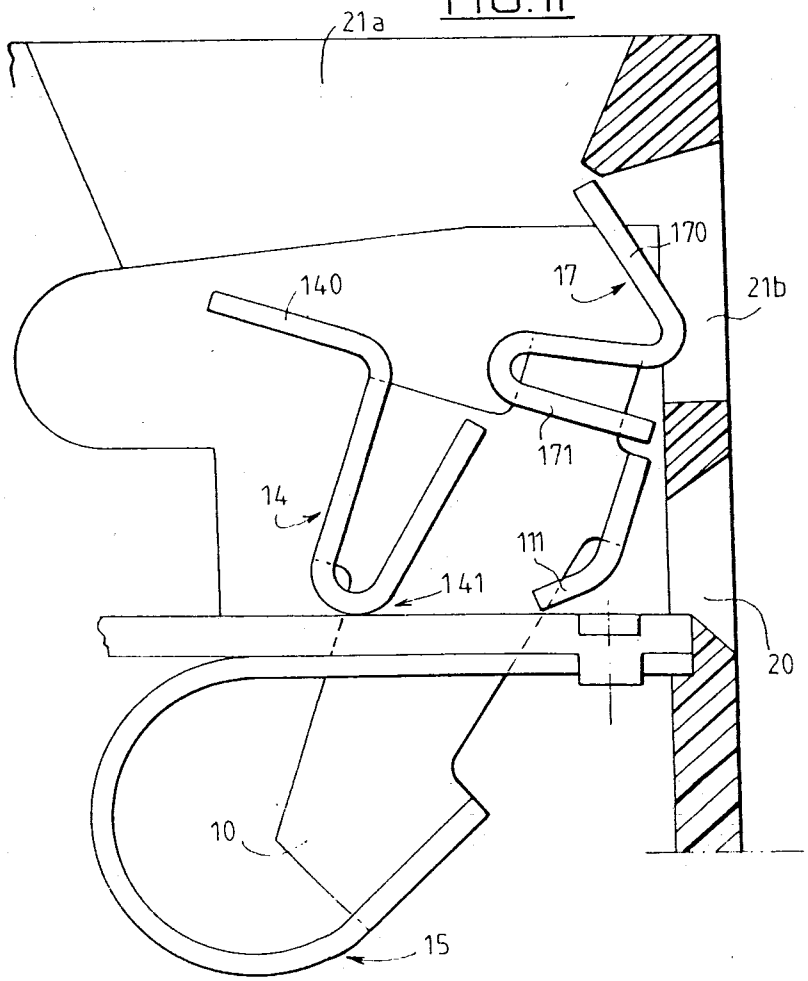
FIG. 11 is a side view of still another embodiment of the connection device.

In a modification (not shown) avoiding the necessity for the socket 16, the ear 14 and its indentation 141 as a stop for the tool are provided and shaped to permit an introduction of the tool in a direction approximately parallel to that of the conductor. In the modification illustrated in FIG. 11, member 1 has the ears 14 and 17 shaped in such a manner as to permit the introduction of a blade of a tool, either in the indentation 141 of the ear 14, or in an indentation 171 of the ear 17; the pivoting of member 1 is obtained in the first case by the introduction of the tool into the opening 21*a* about at right angles to the conductor, and in the second case in the opening 21*b* about parallel to the conductor.

We claim:

1. A connecting device for at least one electric conductor, said device comprising:

a housing provided with at least one first opening for passing said electric conductor therethrough in an introducing direction, and at least one second opening for introduction of a tool, said second opening having a first axis of symmetry;

a flat contact member fixedly mounted within said housing and extending in a first plane, said flat contact member having first and second opposite faces;

a one-piece made tilting member cooperating with said flat contact member for resiliently jamming the electric conductor, said tilting member comprising:

(i) a plane support part having first and second end portions respectively located on the respective sides of the flat contact member, said plane support part extending in a second plane adjacent to the flat contact member, said plane support member substantially extending at right angle to the first plane and parallel to said introducing direction;

(ii) a presser tongue part extending from said first end portion in a third plane making an acute angle with said first plane;

(iii) a resilient part extending from said second end portion at right angle thereto and bearing on said first face of the flat contact member, said resilient part acting on said plane support part in such a way that said presser tongue part will tend to come into abutment with said second face of the contact member for jamming the electric conductor.

2. A connecting device according to claim 1, in which said resilient means comprise a blade extending from said second end portion perpendicularly to said second plane, said blade being curved substantially into U-shape and having a first leg connected to said plane support element, and a second leg which bears on the said first face of the contact element.

3. A connecting device according to claim 1, in which said presser tongue is extended by an antifault portion adapted to avoid the introduction of the tool otherwise than in the indentation.

4. A connecting device according to claim 1, in which said contact element comprises anchoring means for the resilient means and at least a V-shaped groove having a longitudinal axis parallel to said introducing direction, said groove being fluted in a direction perpendicular to said longitudinal axis.

5. A connecting device according to claim 1, in which said single tilting element further comprises a second tongue extending from said first portion perpendicularly to said second plane, said second tongue being provided with an indentation having a second axis of symmetry which coincides with said first axis of symmetry.

6. A connecting device according to claim 5, in which said second tongue is extended by an antifault portion adapted to avoid the introduction of the tool otherwise than in the indentation.

7. A connecting device according to claim 5, which further comprises an insulating socket connected with said second tongue.

* * * * *